US005499674A

United States Patent [19]

Bartz et al.

[11] Patent Number: 5,499,674

[45] Date of Patent: Mar. 19, 1996

[54] MODULAR COOLING SYSTEM SEALING

[75] Inventors: John C. Bartz, Fuquay Varina, N.C.; Paul J. Byrne, Peoria, Ill.

[73] Assignee: Caterpillar Inc., Peoria, Ill.

[21] Appl. No.: 372,528

[22] Filed: Jan. 13, 1995

[51] Int. Cl.[6] ..... F28F 7/00; F28F 9/04

[52] U.S. Cl. ..... 165/76; 165/137; 165/140; 165/144; 165/DIG. 456

[58] Field of Search ..... 165/76, 137, 140, 165/144, 178

[56] References Cited

U.S. PATENT DOCUMENTS

| | | | |
|---|---|---|---|
| 1,482,320 | 1/1924 | Rosenfeld | 165/76 |
| 1,621,648 | 3/1927 | Swanson . | |
| 1,827,568 | 10/1931 | Donadio | 165/76 |
| 2,037,845 | 4/1936 | Young | 165/144 X |
| 2,938,712 | 5/1960 | Pellmyr | 165/137 |
| 3,119,177 | 1/1964 | Knecht | 29/401 |
| 3,744,558 | 7/1973 | Childress | 165/71 |
| 3,776,301 | 12/1973 | Young | 165/67 |
| 4,121,656 | 10/1978 | Huber | 165/72 |
| 4,513,786 | 4/1985 | Sodergren et al. | 138/89 |
| 4,722,122 | 2/1988 | Overbay | 29/157.3 |
| 4,730,668 | 3/1988 | LeMaster | 165/137 |
| 5,042,572 | 8/1991 | Dierbeck | 165/76 |
| 5,325,915 | 7/1994 | Fouts et al. | 165/78 |

*Primary Examiner*—Allen J. Flanigan
*Attorney, Agent, or Firm*—Diana L. Charlton

[57] ABSTRACT

The design and assembly of past modular cooling systems required that cooling modules with different fluids be separated, lowering the efficiency of the system. The present invention overcomes this problem by providing a modular cooling system with a plurality of cooling modules, one of which is a hydraulic oil cooler. The cooling modules are connected to a bottom tank which has a top plate with a pair of openings 64,68 therethrough in each cooling module location so that fluid communication is established between the plurality of cooling modules and the bottom tank. However, fluid communication is blocked between the hydraulic oil cooler module and the bottom tank by inserting a plug in the openings so that fluid within the bottom tank is not leaked to the atmosphere. This results in the ability to mount the hydraulic oil cooler module on the bottom tank along with the remaining plurality of cooling modules having a different fluid therein. Cooling efficiency is improved since incoming air reaches both the hydraulic oil cooler module and the remaining plurality of cooling modules simultaneously.

5 Claims, 2 Drawing Sheets

MODULAR COOLING SYSTEM SEALING

TECHNICAL FIELD

This invention relates generally to a modular cooling system with a plurality of cooling modules and more particularly to the ability to block fluid communication at a specified cooling module location.

BACKGROUND ART

Present day modular cooling systems are designed with a plurality of interconnected cooling modules. Depending on the specific need, the cooling modules can be used to cool various engine fluids, such as oil, transmission fluid, or coolant.

Generally, the various engine fluids are contained within a cooling tank connected to the cooling module and are circulated through the cooling module so that forced air through a fan reduces the fluid temperature. It is sometimes necessary to utilize both coolant cooling modules and hydraulic fluid cooling modules on a single cooling system in order to accommodate the vehicle in which the engine resides. In order to accomplish this purpose, separate cooling modules must be mounted within the vehicle's engine compartment. Generally, due to space limitations, the coolant cooling modules are mounted within a radiator guard in the engine compartment in front of the hydraulic fluid cooling modules. The position of the coolant cooling modules increases the effectiveness of the coolant cooling system since forced air from the fan passes directly through the coolant cooling modules. In comparison, the effectiveness of the hydraulic cooling system is more limited since incoming air does not reach the hydraulic cooling modules until passing through the coolant cooling modules.

The present invention is directed at overcoming the problems as set forth above.

DISCLOSURE OF THE INVENTION

In one aspect of the present invention, a modular cooling system includes a partially hollow bottom tank with upper and lower portions and a plurality of interconnected modules attached to the bottom tank in close proximity to the upper portion. The modular cooling system comprises a top plate positioned between each of the plurality of modules and the bottom tank. The top plate is connected to the bottom tank at the upper portion of the bottom tank. The top plate defines a pair of openings therethrough for fluid communication between the bottom tank and each of the plurality of modules. A plug is disposed within each of the openings for blocking the fluid communication between the bottom tank and at least one of the plurality of modules. Means are disposed between the plug and the top plate for sealing the plug within the openings.

The present invention utilizes a method which allows at least one of the plurality of cooling modules to be utilized for a separate purpose other than the remaining modules. This is accomplished by positioning a plug between the bottom tank and the at least one of the plurality of cooling modules for blocking communication therebetween. The present invention employs an efficient and simple method of blocking communication between the bottom tank and at least one of the plurality of cooling modules so that module may be used for a different cooling function.

BEST MODE FOR CARRYING OUT THE INVENTION

Figure 1:
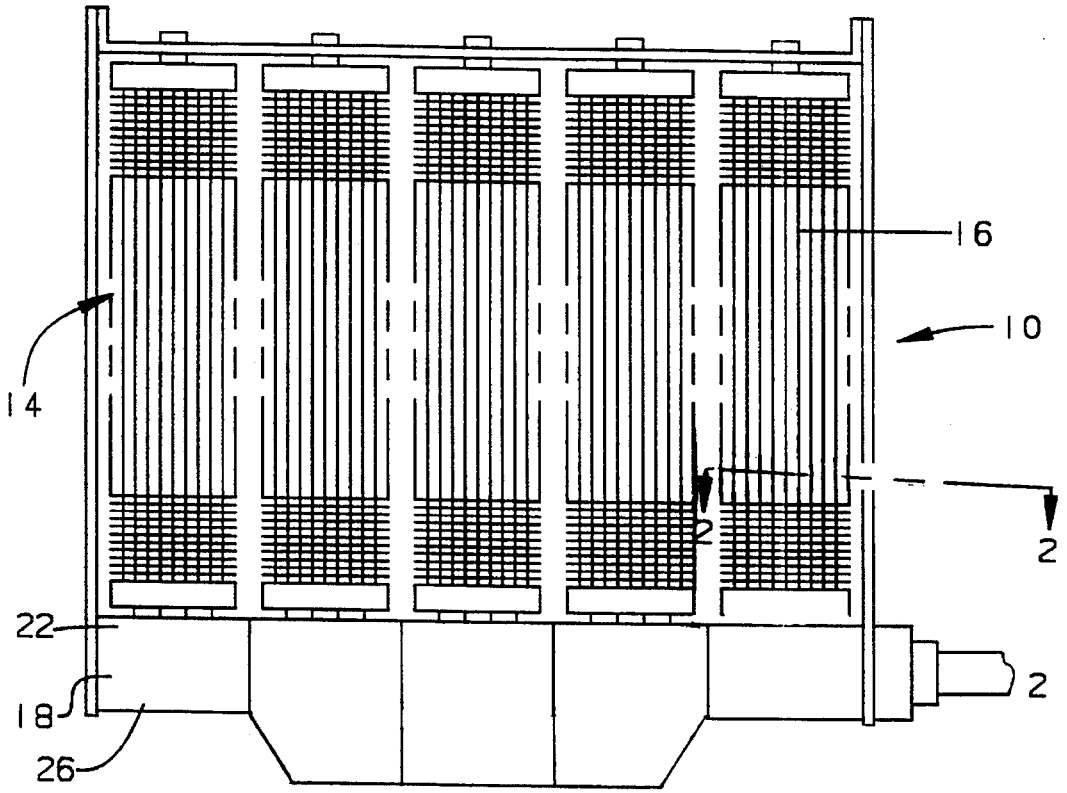
FIG. 1 is an elevation of a modular heat exchanger according to the present invention.
Figure 2:
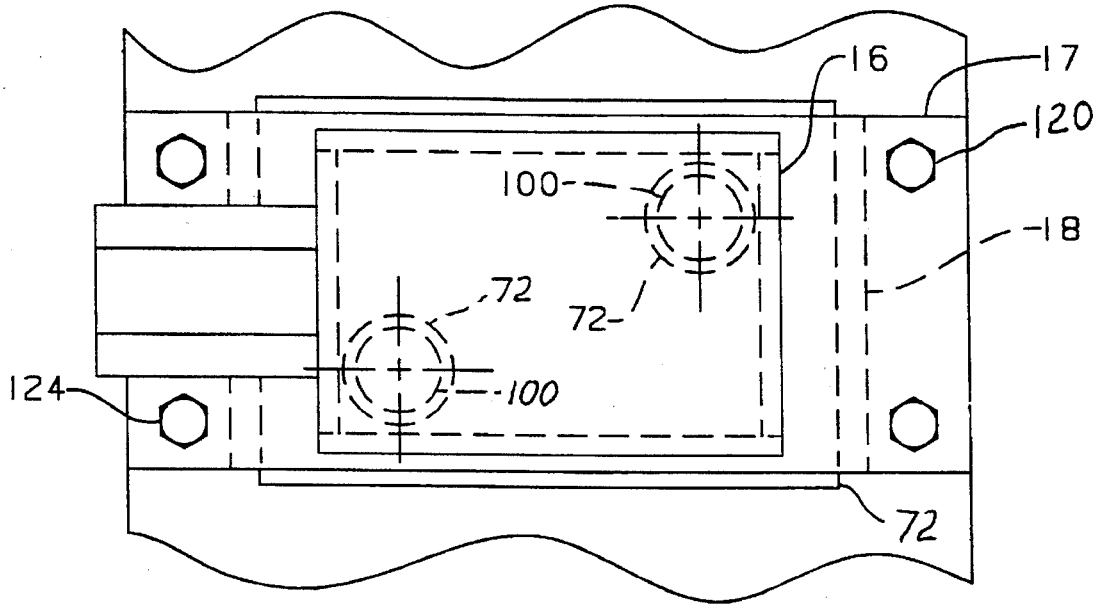
FIG. 2 is a sectional view taken along line 2—2 in FIG. 1 illustrating a top view of the present invention.
Figure 3:
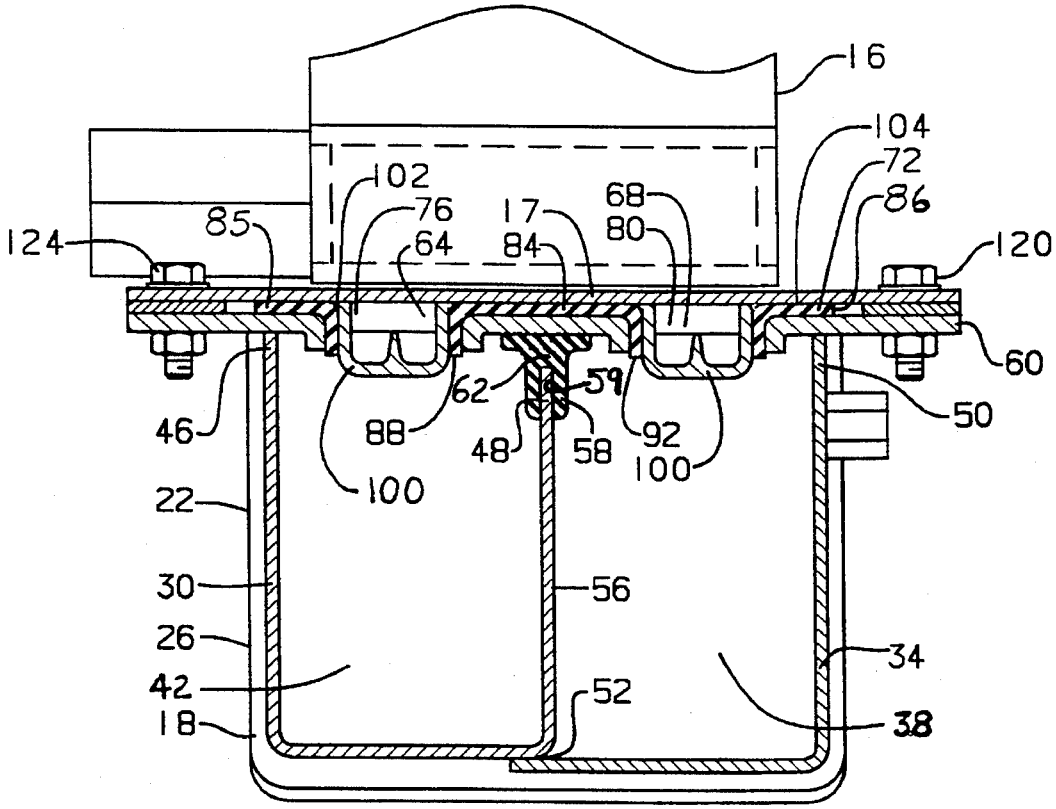
FIG. 3 is a sectional view taken along line 3—3 in FIG. 2 illustrating the side view of the present invention.

Referring now in particular to FIGS. 1–3, a modular cooling system 10 is shown including a plurality of cooling modules 14. The modular cooling system 10 may be used with a conventional internal combustion engine (not shown). At least one of the plurality of cooling modules 14 is a hydraulic oil cooler 16. The hydraulic oil cooler 16 has a bottom plate 17 attached thereon by any suitable connection means, such as welding.

A hollow bottom tank 18 is connected to the plurality of cooling modules 14 and has upper and lower portions 22,26. The bottom tank 18 consists of a first U-shaped plate 30 and a second L-shaped plate 34 which separate the bottom tank 18 into first and second compartments 38,42. The plates 30,34 each have first and second end portions 46,48,50,52. The second end portion 52 of the L-shaped plate 42 is fixedly attached to the first plate 38 by any suitable method, such as welding. The second end portion 48 of the U-shaped plate defines a central partition 56 extending the length of the bottom tank 18. The central partition 56 has a pair of upwardly extending tabs (not shown) located in close proximity to a middle portion (not shown) and at one end portion (not shown). A pair of seals, one of which is shown at 58, are attached to the central partition 56 and are disposed on either side of the tab (not shown) located near the middle portion (not shown) to partially surround the partition 56. The seals 58 each have a notch 59 which receives a portion of the central partition 56 so that the seals 58 are held thereon to sealingly separate the first and second compartments 38,42. A top plate 60 is connected to the bottom tank 18 at the first end portion 46,50 of the plates 38,42 by any suitable method, such as welding. Additionally, the central partition 56 is stabilized against the top plate 60 by connecting the tabs (not shown) in any suitable manner, such as spot welding, so that a sealed joint is developed therebetween. A gap 62 is therefore defined between the central partition 56 and the top plate 60 in the remaining portion of the central partition 56 without the extending tabs (not shown) so that the seals 58 may bridge therebetween. The top plate 60 has a plurality of openings therethrough, two of which are shown at 64,68,.

A radial seal 72 is disposed between the plurality of cooling modules 14 and the top plate 60 extending radially along a portion of the top plate 60. The radial seal 72 has a pair of openings 76,80 coaxial with the pair of openings 64,68. The radial seal 72 has a planar middle portion 84 and second end portion 85,86 extending radially outwardly from the middle portion 84, and a pair of annular protuberances 88,92 extending downwardly from the seal 72 at the first and second end portions, respectively, through the openings 64,68 toward the bottom tank 18. The middle portion 84 has a predetermined thickness of approximately 4 mm radially extending a specified distance with a gradually decreasing thickness outwardly therefrom toward the first and the second end portions 85,86 thereby providing a bevel-type seal. A plug 100 is positioned within the annular protuberances 88,92 extending through the openings 64,68 and has an upper annular lip 102 extending outwardly a predetermined distance to cover a portion of an upper surface 104 of the radial seal 72.

The bottom plate 17 of the hydraulic oil cooler 16 is attached to the top plate 60 by any suitable connection means, such as a plurality of bolts and nuts, two of which are shown at 120 and 124.

INDUSTRIAL APPLICABILITY

During operation in an internal combustion engine, coolant, such as an ethylene-glycol mixture, reaches an elevated temperature and is circulated from the engine into the first compartment 38 of the bottom tank 18. The coolant within the first compartment 38 is sealingly separated from the second compartment 42 due to the seals 58. The seals 58 have a specified cross-sectional area and shape so that, with the pressures prevailing in the compartments 38,42 separated by the partition 56 being different and with the compression from the top plate 60, the seals 58 are pressed into the gap 62 between the top plate 60 and the partition 56 due to the action of the pressure difference. The coolant circulates through the plurality of cooling modules 14, except the hydraulic oil cooler, in a conventional manner so that the coolant temperature is reduced. The lower temperature coolant is then circulated from the plurality of cooling modules 14 to the second compartment 42 for recirculation through the engine.

Coolant within the bottom tank 18 is blocked from entering the atmosphere through the use of the plug 100 within the openings 164,68. The connection of the hydraulic oil cooler 16 to the top plate 60 holds the plug 100 in place between the radial seal 72 and the bottom plate 17. Simultaneously, the radial seal 72 is compressed providing virtually complete sealing between the plug 100 and the bottom tank 18. It should be understood that fluid communication between the hydraulic oil cooler 16 and the bottom tank 18 is blocked through the bottom plate 17 although it could be blocked through only the plug 100. Hydraulic fluid is circulated through the hydraulic oil cooler 16 in any suitable manner.

In view of the above, it is apparent that the present invention provides a simple and effective means for positioning both coolant cooling modules and hydraulic fluid cooling modules on a single tank, thus reducing spatial requirements and increasing the capacity for air flow through the different cooling modules. The present invention utilizes a plurality of cooling modules connected to a bottom tank. Fluid communication between the plurality of cooling modules and the bottom tank is accomplished through a pair of openings on the modules and the bottom tank. At least one of the plurality of cooling modules is a hydraulic oil cooler in which the fluid communication is blocked with the bottom tank. A plug and seal are disposed within the openings of the bottom tank corresponding to the position of the hydraulic oil cooler. The plug and seal effectively block fluid communication between the hydraulic oil cooler and the bottom tank and eliminate leakage of fluid from the bottom tank into the atmosphere.

We claim:

1. A modular cooling system including:

a partially hollow bottom tank having upper and lower portions and a plurality of modules attached to the bottom tank in close proximity to the upper portion;

a top plate positioned between each of the plurality of modules and the bottom tank and connected to the bottom tank at the upper portion, the top plate defining a pair of openings therethrough for fluid communication between the bottom tank and each of the plurality of modules;

a plug disposed within each of selected openings for blocking the fluid communication between the bottom tank and at least one of the plurality of modules; and means disposed between the plug and the top plate for sealing the plug within the openings.

2. The modular cooling system of claim 1, wherein the sealing means defines a pair of openings coaxial with the openings in the top plate, the openings in the sealing means terminating at a annular protuberance extending downwardly into the bottom tank through the openings in the top plate.

3. The modular cooling system of claim 1, wherein the at least one of the plurality of modules has an attached bottom plate connected to the top plate of the bottom tank.

4. The modular cooling system of claim 1, wherein the at least one of the plurality of modules is a hydraulic oil cooler.

5. The modular cooling system of claim 3, wherein the plug extends through the openings in the sealing means and has an upper annular lip disposed between the bottom plate of the at least one of the plurality of modules and the sealing means.

* * * * *